United States Patent [19]
Ruspa et al.
[11] 4,253,542
[45] Mar. 3, 1981

[54] EXHAUST SILENCER FOR EARTH MOVING MACHINES

[75] Inventors: Giacomo Ruspa, Turin; Giancarlo Schellino, Mondovi, both of Italy

[73] Assignee: Centro Ricerche Fiat S.p.A., Turin, Italy

[21] Appl. No.: 20,788

[22] Filed: Mar. 15, 1979

[30] Foreign Application Priority Data

Mar. 16, 1978 [IT] Italy ..... 53061/78[U]

[51] Int. Cl.³ ..... F01N 1/08
[52] U.S. Cl. ..... 181/272; 181/275
[58] Field of Search ..... 181/272, 275, 269, 255, 181/230, 281, 266

[56] References Cited

U.S. PATENT DOCUMENTS

| | | | |
|---|---|---|---|
| 2,241,010 | 5/1941 | Chipley | 181/272 |
| 2,287,412 | 6/1942 | Bowine | 181/272 |
| 2,919,761 | 1/1960 | Smith | 181/272 |
| 4,109,751 | 8/1978 | Kabele | 181/272 |
| 4,177,875 | 12/1979 | Kurobe et al. | 181/266 |

FOREIGN PATENT DOCUMENTS

| | | | |
|---|---|---|---|
| 593282 | 10/1947 | United Kingdom | 181/272 |

*Primary Examiner*—John Gonzales
*Assistant Examiner*—Benjamin R. Fuller
*Attorney, Agent, or Firm*—Sughrue, Rothwell, Mion, Zinn & Macpeak

[57] ABSTRACT

An exhaust silencer for an earth moving machine having an engine of about 10 liters capacity and a maximum power of about 150–160 HP has a cylindrical wall closed at opposite ends by first and second end walls and subdivided into two internal chambers by a transverse partition having therein four tube sections. To optimize the acoustic performance specific dimensions of the two chambers, of the tube sections and of inlet and outlet tubes in the end walls are prescribed.

1 Claim, 2 Drawing Figures

EXHAUST SILENCER FOR EARTH MOVING MACHINES

Figure 1:
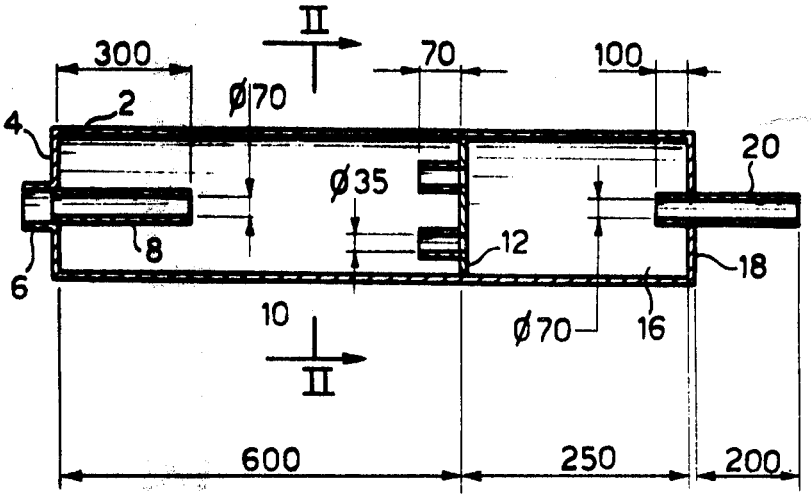

This invention relates to exhaust mufflers for earth moving machines.

More particularly the invention concerns exhaust mufflers for earth moving machines provided with engines of about 10 liters capacity and a maximum power of about 150–160 HP, with natural air induction.

In the known stage of the art exhaust mufflers are available which, although considered to be acceptable as regards noise attenuation, suffer from the disadvantage that they cause a loss of power of engines to which they are fitted. Such known mufflers generally have a complex internal geometrical configuration and are consequently expensive. Such mufflers also use glass fiber insulation which has the tendency to become clogged with time losing, therefore, its effectiveness.

An object of the present invention is to avoid the aforesaid disadvantages by providing a muffler which is fabricated in sheet-metal and is of simple construction, avoiding the use of glass fiber or like materials which deteriorate with time.

Another object of this invention is to provide a muffler which has, compared with mufflers of the known type referred to, a better performance both from the fluid-dynamic point of view, with a smaller loss of engine power, and acoustically, in satisfying the rules currently in force which stipulate mean exhaust noise levels not greater than 74dB (A), at the frequency of greatest sensitivity of the human ear, at distances of 5–7 meters from the engine concerned, and at a height of 1–2 meters above the ground.

The present invention accordingly provides an exhaust muffler, particularly for an earth moving machine having an engine of about 10 liters cylinder capacity and a maximum power of about 150–160 HP, with natural air induction, of the type comprising an external cylindrical wall closed at one end by a first end wall and at the other end by a second end wall, characterised in that, for the purpose of optimizing the acoustic performance of the muffler without undue loss of power the muffler is subdivided internally by a transverse partition into first and second expansion chambers having internal diameters of 250 millimeters, the partition being spaced 600 millimeters from said first end wall and 250 millimeters from said second end wall and having therein four tube sections, each having an internal diameter of 35 millimeters, arranged with their axes spaced apart angularly at 90° intervals on a circle of 160 millimeters diameter, each tube section projecting for a length of 70 millimeters from the partition into said first chamber, and further characterised in that said first end wall is provided with a central inlet tube with an internal diameter of 70 millimeters which extends for a length of 300 millimeters into said first chamber and said second end wall has a central outlet tube therein, said outlet tube having an internal diameter of 70 millimeters and extending for a length of 100 millimeters into said second chamber, and projecting from said second end wall externally for a length of 200 millimeters.

Figure 2:
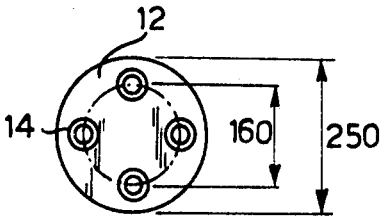

The invention will be further described, by way of example, with reference to the accompanying drawings, in which:

FIG. 1 is a longitudinal section of an exhaust muffler according to one embodiment of the invention, and FIG. 2 is a cross-sectional view taken on the line II—II of FIG. 1.

Referring first to FIG. 1, the illustrated exhaust muffler, indicated generally 1, has an external wall 2 which is cylindrical in shape, having an internal diameter of 250 millimeters and a length of 850 millimeters. The wall 2 is closed at one end (on the left as shown in FIG. 1) by a front end wall 4 formed with a central outwardly projecting tubular inlet 6 for connection to the engine exhaust. An internal inlet tube 8, coaxial with the inlet 6, is fixed to the wall 4. The tube 8 has an internal diameter of 70 millimeters and projects for a length of 300 millimeters into a first expansion chamber 10 defined within the cylindrical wall 2 between the end wall 4 and a transverse partition 12 spaced by a distance of 600 millimeters from the front end wall 4.

As shown in FIG. 2, the partition 12 has fixed to it four integral tube sections 14 extending axially and each having an internal diameter of 35 millimeters, each tube section 14 affording communication between the first chamber 10 and a second expansion chamber 16 defined between the partition 12 and a rear end wall 18. The four tube sections 14 are arranged symmetrically, at equal angular intervals of 90°, on a common circle, concentric with the cylindrical wall 2, having a diameter of 160 millimeters. Each tube section 14 projects axially a distance of 70 millimeters in an upstream direction into the first expansion chamber 10.

The second expansion chamber 16 has a length of 250 millimeters. The rear end wall 18 has fixed centrally therein an outlet tube 20 with an internal diameter of 70 millimeters, which projects axially a distance of 100 millimeters into the second chamber 16 and projects externally from the rear end wall 18 for a distance of 200 millimeters.

The operation of the exhaust muffler is as follows: the exhaust gases from the engine pass through the inlet tube 8 and enter the first expansion chamber 10 where the gases expand before passing through the four tube sections 14 in the partition 12 to enter the second expansion chamber 16, where the gases expand further before leaving the muffler through the outlet tube 20.

In the illustrated embodiment the dimensions shown can have a tolerance not greater than ±1 mm, as it is only by strict adherence to these dimensions that the muffler can fulfill its functions to the optimum.

What is claimed is:

1. Exhaust muffler for an earth moving machine having an engine cylinder capacity of about 10 liters and a maximum power of about 150–160 HP, with natural air induction, comprising a body having an external cylindrical wall and first and second end walls closing opposite ends of the cylindrical wall, wherein:

the muffler body has an internal partition which subdivides the interior of said body into first and second expansion chambers having internal diameters of 250 millimeters, said partition being spaced 600 millimeters from said first end wall and 250 millimeters from said second end wall;

four tube sections are supported by said partition in alignment with apertures therethrough and project only into said first chamber, said tube sections having an internal diameter of 35 millimeters, and being arranged with their axes spaced apart angularly at 90° intervals on a circle of 160 millimeters diameter, each said tube section projecting for a length of 70 millimeters from the partition into said first chamber, said first end wall is provided with a central inlet tube thereon having an internal diameter of 70 millimeters which extends for a length of 300 millimeters into said first chamber and said second end wall has a central outlet tube therein having an internal diameter of 70 millimeters and extending for a length of 100 millimeters into said second chamber, said outlet tube projecting from said second end wall externally of the muffler body for a length of 200 millimeters.

* * * * *